US008273218B2

(12) United States Patent
Köckritz

(10) Patent No.: US 8,273,218 B2
(45) Date of Patent: Sep. 25, 2012

(54) PRESS FELT AND METHOD FOR THE PRODUCTION THEREOF

(75) Inventor: Uwe Köckritz, Heidenheim (DE)

(73) Assignee: Voith Patent GmbH, Heidenheim (DE)

( * ) Notice: Subject to any disclaimer, the term of this patent is extended or adjusted under 35 U.S.C. 154(b) by 0 days.

(21) Appl. No.: 13/112,518

(22) Filed: May 20, 2011

(65) Prior Publication Data

US 2011/0290443 A1 Dec. 1, 2011

Related U.S. Application Data

(63) Continuation of application No. PCT/EP2009/065579, filed on Nov. 20, 2009.

(30) Foreign Application Priority Data

Nov. 20, 2008 (DE) ..... 10 2008 043 917

(51) Int. Cl.
*D21F 3/00* (2006.01)

(52) U.S. Cl. ..... 162/358.2

(58) Field of Classification Search ..... 162/358.2, 162/358.1, 900; 442/62, 320; 28/110, 142; 156/178, 182
See application file for complete search history.

(56) References Cited

U.S. PATENT DOCUMENTS

| | | | |
|---|---|---|---|
| 3,653,961 | A | 4/1972 | Lefkowitz |
| 3,664,905 | A | 5/1972 | Schuster |
| 3,948,722 | A | 4/1976 | Wheeldon et al. |
| 4,359,069 | A | 11/1982 | Hahn |
| 4,781,967 | A | 11/1988 | Legge et al. |
| 5,346,567 | A | 9/1994 | Barnewall |
| 6,294,485 | B1 | 9/2001 | Hodson et al. |
| 8,123,911 | B2 | 2/2012 | Koeckritz et al. |
| 2002/0102894 | A1 | 8/2002 | Hansen |
| 2004/0005833 | A1 | 1/2004 | Best |
| 2006/0016545 | A1 | 1/2006 | Hansen |
| 2007/0026751 | A1 | 2/2007 | Westerkamp |
| 2007/0235155 | A1 | 10/2007 | Best et al. |

(Continued)

FOREIGN PATENT DOCUMENTS

DE 10 2008 000 915 A1 10/2009

(Continued)

OTHER PUBLICATIONS

English translation of International Preliminary Report on Patentability dated May 31, 2011 for PCT/EP2009/065579 (10 pages).

(Continued)

*Primary Examiner* — Mark Halpern
(74) *Attorney, Agent, or Firm* — Taylor IP, P.C.

(57) ABSTRACT

A paper machine clothing, in particular a press felt for a paper, cardboard or tissue machine, includes a load bearing base structure that extends in the longitudinal and cross directions of the clothing and which is formed, for example from a longitudinal reinforcement module substantially providing the dimensional stability in longitudinal direction of the clothing, and a transverse reinforcement module substantially providing the dimensional stability in the cross direction of the clothing, which is arranged on the longitudinal reinforcement module and is connected with same. The transverse reinforcement module is a warp knit fabric, which includes at least one system of warp threads arranged parallel to each other and one system of stitch-forming sewing threads extending substantially perpendicular thereto into which the warp threads are integrated to form a textile fabric. The warp threads extend transversely to the longitudinal direction of the clothing and have a greater flexural strength than the sewing threads.

36 Claims, 5 Drawing Sheets

U.S. PATENT DOCUMENTS

| | | | |
|---|---|---|---|
| 2009/0199988 | A1 | 8/2009 | Westerkamp et al. |
| 2009/0242159 | A1 | 10/2009 | Kockritz et al. |
| 2011/0294386 | A1 | 12/2011 | Koeckritz et al. |

FOREIGN PATENT DOCUMENTS

| | | | |
|---|---|---|---|
| DE | 20 2009 010 898 | U1 | 3/2010 |
| DE | 10 2008 043 855 | A1 | 5/2010 |
| DE | 10 2009 002 175 | A1 | 10/2010 |
| EP | 1 837 440 | A1 | 9/2007 |
| EP | 2 107 159 | A1 | 10/2009 |
| GB | 1 058 616 | | 2/1967 |
| WO | 8903300 | A1 | 4/1989 |
| WO | 97/14846 | A1 | 4/1997 |
| WO | 99/41447 | A1 | 8/1999 |
| WO | 2010/057802 | A2 | 5/2010 |

OTHER PUBLICATIONS

English translation of Written Opinion of the International Searching Authority (undated) for PCT/EP2009/065579 (9 pages).

International Search Report dated Mar. 8, 2010 for PCT/EP2009/065579 (2 pages).

International Search Report for PCT/EP2009/065579 dated Aug. 3, 2010. (4 pages).

Communication dated Jun. 29, 2009 from European Patent Office in European patent application No. EP 09155325.5.2314 (7 pages).

Communication dated Jun. 5, 2010 from European Patent Office in European patent application No. EP 09155325.5.2314 (1 page).

PRESS FELT AND METHOD FOR THE PRODUCTION THEREOF

CROSS REFERENCE TO RELATED APPLICATIONS

This is a continuation of PCT application No. PCT/EP2009/065579, entitled "PRESS FELT AND METHOD FOR THE PRODUCTION THEREOF", filed Nov. 20, 2009, which is incorporated herein by reference.

BACKGROUND OF THE INVENTION

1. Field of the Invention

The present invention relates to paper machine clothing, especially a press felt for a paper-, cardboard- or tissue machine, as well as to a method for producing the paper machine clothing.

2. Description of the Related Art

Paper machine clothing, especially press felts for paper-, cardboard- or tissue machines normally include a basic structure which provides the dimensional stability of the felt, and which is furnished with one or more fibrous nonwoven layers.

In the past the objective in the development of new press felts was to replace the felt belts through a modular composition of individual components and to thereby replace woven structures, since woven structures can only be produced with low productivity.

WO89/03300, for example, shows press felts composed of modules. Here, modules are suggested which are composed of a laid structure of longitudinal threads which is bonded with one fibrous nonwoven layer, as well as modules which consist of a laid structure of cross threads which is bonded with one fibrous nonwoven layer.

In order to simplify the production of modular press felts of this type it is further suggested in EP 1837440A1 to produce the tensile load bearing longitudinal reinforcement module from a laid structure of longitudinal threads which is bonded with a fibrous nonwoven layer in one winding process. The transverse-reinforcement module which is used to increase the transverse stability is constructed from several transverse-reinforcement module segments which extend only along part of the length of the press felt and which are produced in a first manufacturing step, also through a winding process like the longitudinal reinforcement module. In a subsequent manufacturing step, the transverse-reinforcement module segments are trimmed to the width of the press felt that is to be produced, oriented with their threads transversely to the laid structure of longitudinal threads, and arranged after one another in a longitudinal direction of the felt. A disadvantage of these transverse reinforcement structures is that they are produced from a laid structure of longitudinal threads which is ready-made to be used as a transverse reinforcement module and must be trimmed and which consist of a plurality of individual segments arranged after one another in the longitudinal direction of the press felt.

The known modular press felt concepts consist of laid structures of longitudinal threads and of laid structures of cross threads, whereby the two laid structures are bonded with each other through only one fibrous nonwoven layer. A disadvantage of these structures is that such laid structures often only provide a very limited void volume in the press felt. Also, since the laid structures of longitudinal and cross threads can move against each other, they move aside for each other when running through the press nip, which can lead to a further reduction of the void volume and consequently to a reduction in the water absorption capacity.

What is needed in the art is a paper machine clothing, especially a press felt, which maintains a substantially high void volume and which moreover is more cost effective than the press felts known from the current state of the art.

SUMMARY OF THE INVENTION

The present invention provides a paper machine clothing, in particular a press felt for a paper, cardboard or tissue machine, including a load bearing base structure that extends in a longitudinal and a cross direction of the clothing and which is formed from a longitudinal reinforcement module substantially providing the dimensional stability in the longitudinal direction of the clothing, and a transverse reinforcement module at least partially, for example substantially, providing the dimensional stability in the cross direction of the clothing, whereby the transverse reinforcement module and the longitudinal reinforcement module are arranged one on top of the other and are interconnected with each other.

The present invention further provides a transverse reinforcement module including at least one material segment formed by a warp knit fabric, including at least one system of warp threads arranged parallel to each other in their longitudinal orientation, and of sewing threads that form stitches, the stitch-forming sewing threads including at least one system of first sewing threads which extend diagonally or transversely to the warp threads and which integrate the warp threads with each other to form a textile fabric. The warp threads in their longitudinal orientation extend diagonally, for example transversely, to the longitudinal direction of the clothing and have a greater flexural strength than the sewing threads.

According to the present invention, first sewing threads are threads which connect various warp threads with each other, in other words, they are sewing threads which are interconnected with the warp threads to form a structure. The present invention provides that there can be several systems of first sewing threads. A system is characterized in that all its threads are interconnected in the same way.

According to the present invention, the longitudinal reinforcement module and the transverse reinforcement module are produced independently of each other. The dimensional stability of the clothing in the longitudinal direction of the clothing is substantially provided by the longitudinal reinforcement module, whereas the dimensional stability of the clothing in the transverse or width direction of the clothing is provided at least partially, for example substantially, by the transverse reinforcement module.

The term "the dimensional stability of the clothing in the longitudinal direction of the clothing is substantially provided by the longitudinal reinforcement module" is to be understood that more than approximately 50% of the longitudinal stability of the clothing is provided by the longitudinal reinforcement module. In addition it must be stated that the longitudinal reinforcement module can contribute also partially to providing the dimensional stability of the clothing in the transverse or width direction of the clothing.

The term "the dimensional stability of the clothing in the transverse or width direction of the clothing is provided at least partially by the transverse reinforcement module" is to be understood that at least a part of the transverse stability of the clothing is provided by the transverse reinforcement module.

The term "the dimensional stability of the clothing in the transverse or width direction of the clothing is provided substantially by the transverse reinforcement module" is to be understood that more than approximately 50% of the transverse stability of the clothing is provided by the transverse reinforcement module.

A textile fabric is to be understood to be a self-supporting textile structure which is flat, meaning that its length and width are considerably greater than its height. It is conceivable in this context that the width and length are greater than a factor of 100, for example greater than a factor of 1000 than the height.

The modular paper machine clothing according to the present invention includes a transverse reinforcement module, which provides the transverse stiffness of the clothing at least partially, for example substantially. The transverse reinforcement module includes at least one material segment in the embodiment of a warp knit fabric which is formed by at least one warp thread system, as well as at least one stitch forming sewing thread system. Herein the material segment is arranged on the longitudinal reinforcement module so that the warp threads of the warp knit fabric extend diagonally, for example transversely, to the longitudinal direction of the clothing. The transverse stiffness of the transverse reinforcement module is provided at least partially, for example substantially, by the warp threads, whereas the stitch forming threads serve to hold the warp threads in position during manufacture of the clothing. The warp knit fabric can be produced cost effectively in the knitting process as a flat one-piece textile fabric with any desired longitudinal extension in the direction of the warp threads and can subsequently be trimmed to the width of the paper machine clothing which is to be produced. The warp knit fabric according to the present invention can therefore be produced in its longitudinal direction—which is determined by the orientation of the sewing threads—in any desired length.

Since the warp knit fabric according to the present invention can be produced in almost any desired length along its warp threads, and the dimensionally stable warp threads extend diagonally or perpendicular to the longitudinal direction of the clothing, a transverse reinforcement structure is provided which can be used for a paper machine clothing of any desired width.

Use of a nonwoven material for the transverse reinforcement module in order to hold a laid thread structure in position, as known from EP1837440A1, can be eliminated according to the present invention since the warp threads are held in position by the stitch forming sewing threads. An expensive needling process like the one known from EP1837440A1 can therefore be eliminated. Moreover, an expensive weaving process to produce a transverse reinforcement is no longer necessary.

The present invention further provides that the transverse reinforcement module may be formed from one or several material segment(s) of a warp knit fabric. It is conceivable that the longitudinal reinforcement module is produced as an endless belt. This can be the case, for example, if the longitudinal reinforcement module is produced as a spiralized laid structure of threads, or as an endless woven fabric. Moreover it is conceivable that the longitudinal reinforcement module is produced to be seamable.

According to a first embodiment of the present invention, the longitudinal reinforcement module includes a laid structure of longitudinal threads or is formed by such, thereby simplifying the base structure and making its production more cost effective. In this case, the laid structure of longitudinal threads may be formed by at least one longitudinal thread extending in a substantially longitudinal direction of the clothing and wound continuously spirally in the cross direction of the clothing. The at least one longitudinal thread is wound, for example, on the width of the base structure.

If the laid thread structure is formed by only a single longitudinal thread, then the thread extends substantially in the provided longitudinal direction of the felt belt and can be wound continuously spirally in the direction of the provided width of the felt belt, until the width of the felt belt is reached. By the spiral winding of the longitudinal thread, a laid longitudinal thread structure can be formed wherein each winding of the longitudinal thread extends parallel to the preceding and following winding of the longitudinal thread.

If the laid structure of longitudinal threads is formed by several longitudinal threads, that is by a group of longitudinal threads, then the individual longitudinal threads substantially extend in the provided longitudinal direction of the felt belt and are arranged side by side in the provided cross direction of the felt belt. The arrangement of the longitudinal threads in the direction of the provided width of the felt belt can be wound spirally continuously until the width of the felt belt is reached. Through the spiral winding of the longitudinal thread arrangement, a laid longitudinal thread structure can be formed wherein all longitudinal threads of the arrangement always progress parallel to each other and wherein each winding of each longitudinal thread extends parallel to the preceding and the following winding of the longitudinal thread.

The term "that the longitudinal thread or threads extends/extend substantially in the longitudinal direction of the belt" is to be understood according to the present invention that the longitudinal thread(s) of the laid longitudinal thread structure and the longitudinal direction of the felt belt together form an angle of approximately 10° maximum, for example approximately 5° maximum.

If the longitudinal reinforcement module includes a laid structure of threads, the dimensional stability of the clothing in its longitudinal direction is substantially provided by the longitudinal reinforcement module. Moreover, in this case, the dimensional stability of the clothing in its transverse or width direction is substantially provided by the transverse reinforcement module.

An additional embodiment of the present invention provides that the longitudinal reinforcement module is formed by a woven fabric and/or a knit fabric and/or a spiral screen and/or a knitted fabric. In this case, it is for example conceivable that the dimensional stability of the clothing in the longitudinal direction of the clothing is substantially provided by the longitudinal reinforcement module. In addition, it is conceivable that the dimensional stability of the clothing in the transverse or width direction of the clothing is partially provided respectively by the transverse reinforcement module and by the longitudinal reinforcement module. In this case, for example approximately 50% or more of the dimensional stability of the clothing in its transverse or width direction is provided by the longitudinal reinforcement module and accordingly less than approximately 50% is provided by the transverse reinforcement module.

The longitudinal reinforcement module in the embodiment of a woven fabric can be woven round or flat.

Further the stitch-forming sewing threads include at least one system of second sewing threads, which form stitch rows extending in the longitudinal direction of the warp threads and which envelop the warp threads at least in sections. Here, each warp thread may be enveloped, at least partially, by at least one stitch row of second sewing threads, whereby the respectively enveloped warp thread is integrated into the stitches. Moreover, the second sewing threads which are enveloping the warp threads may, for example, be integrated into stitches of the first sewing threads which connect the various warp threads with each other. The second warp threads have a greater flexural strength than the second sewing threads.

According to the present invention, second sewing threads are threads which envelop warp threads. In other words, they are sewing threads into whose stitches the warp threads are integrated in a way that the warp threads are enveloped at least partially by them. According to the present invention, several systems of second sewing threads may be included. A system is characterized in that all its threads are interconnected in the same way.

It is also conceivable that each warp thread is enveloped by several stitch rows of second sewing threads. It is further conceivable that the stitch rows of second sewing threads complete each other when covering a respective warp thread. In this context it is conceivable that at least two systems of second sewing threads are provided, specifically a first system of second sewing threads and a second system of second sewing threads, which together envelop the warp threads. It is also conceivable that adjacent second sewing threads, which are interconnected with respectively different warp threads, are also interconnected amongst each other.

Each of the first sewing threads extends, for example, in a zigzag line between warp threads, whereby the zigzag line progresses in a direction of the longitudinal extension of the warp threads.

One embodiment of the present invention provides that each second sewing thread is integrated into stitches of several first sewing threads. It is moreover conceivable that, during integration of the second sewing thread into a stitch of a first sewing thread, the first and the second sewing thread together form a common stitch. In addition it is possible that the first and second sewing threads are thinner than the warp threads.

A further embodiment of the present invention provides that the transverse reinforcement module includes only one system of warp threads arranged parallel to each other. Moreover, the stitch-forming sewing threads include, for example, only one system of first sewing threads and two systems of second sewing threads. This further simplifies the structure of the transverse reinforcement module.

The individual first sewing threads are, for example, not interconnected with each other, but solely through second sewing threads. In other words, they are connected with each other through the enveloping structure of the warp threads. The rows of stitches of the second sewing threads may extend in the cross direction of the clothing. An additional embodiment of the present invention provides that each second sewing thread forms its own row of stitches.

The warp threads may, for example, be enveloped by a tricot weave of a first and a second system of sewing threads. It is moreover conceivable that each of the first sewing threads, that is the structure forming sewing threads connecting the warp threads, forms a cord or velvet weave. As a result, a warp knit fabric is provided wherein each warp thread is enveloped by a second sewing thread of the first system together with a second sewing thread of the second system, and various warp threads are connected with each other by first sewing threads, whereby warp threads are tied into stitches of second sewing threads of the first and the second system, which again are tied into the stitches of the first sewing threads.

In order to provide a sufficiently high void volume, the warp threads may be formed by multifilament yarns, for example by twisted monofilaments.

In known seamable press felts with a woven base structure or with a longitudinal reinforcement module including a laid structure of longitudinal threads, the longitudinal threads form seam loops. In order to permit insertion of a pintle through the seam loops, the longitudinal threads are in the form of monofilaments. Furthermore, the transverse threads in these types of known woven base structures are also in the form of monofilaments, often making anchoring through needling of the nonwoven layers on the base structure difficult.

Through the provision of the transverse reinforcement module in which the weft threads are formed by multifilament yarn according to the present invention, anchoring of the fibrous nonwoven layers on the base structure through needling can be clearly improved, since the fibers in the fibrous nonwoven layer(s) interlock in the multifilament yarns during the needling process.

It is conceivable, for example, that the monofilaments are produced from polyamide (PA).

The twisted warp threads can possess a count of approximately 50-500 tex, for example approximately 100-400 tex. For the first and/or second sewing threads a number, for example in the range of approximately 8-200 tex is conceivable, for example approximately 21-120 tex. It is of course also conceivable that the warp threads are formed by monofilament threads.

The warp knit fabric of the paper machine clothing according to the present invention may be produced flat, or in other word, open ended.

The transverse reinforcement module can moreover include a material segment of a warp knit fabric which extends on the width of the clothing. The transverse reinforcement module may, for example, include several material segments, extending respectively the width of the clothing and only on a part of the length of the clothing, and which are arranged behind one another in the longitudinal direction of the clothing, together making up the length of the clothing. It is conceivable that each material segment extending the width of the clothing extends in a range of approximately 0.5 to 8 meters in the longitudinal direction of the clothing.

The material segment which is formed by the warp knit fabric can be limited in its length by two transverse edges. Since, in the transverse reinforcement module according to the present invention the warp knit fabric in its longitudinal direction—that is in the direction of its warp threads—is arranged transversely to the longitudinal direction of the paper machine clothing, the transverse edges of the material segment extend in the longitudinal direction of the warp knit fabric. Further, the warp knit fabric in its transverse orientation extends in longitudinal direction of the clothing and the length of the material segment in the longitudinal direction of the clothing is established by its width.

In order to make the transverse reinforcement module endless, the transverse edges of adjacent material segments are, for example, abutted with each other. It is conceivable that adjacent material segments are made endless by means of a connecting strip, in that the connecting strip covers the two abutting transverse edges and is interconnected with the respective material segment in the area of the two transverse edges. In order to prevent fraying at the transverse edges, in the area of at least one of the transverse edges, a material strip may be connected with the material segment whose edge is flush with the transverse edge.

In order to reduce the tendency of marking on the clothing produced with the material strip(s) and/or connecting strip, the connecting strip and/or the material strip(s) is, or respectively are made of at least one film and/or one spun nonwoven material. This may, for example, be a film made from polyamide (PA), polyamide copolymer (CoPA), polyethylene terephthalate (PET), polyethylene terephthalate copolymer (CoPET), polyurethane (PU), ethylene vinyl acetate (EVA), polypropylene (PP), thermoplastic polyurethane (TPU) or polyvinyl acetate (PVA). The film can have a base weight in the range of approximately 10-500 g/m$^2$, for example 20-60 g/m$^2$. Films consisting of several components are also conceivable, for example PET-PU films, PA-PU films, PET-PA films. Films of this type can have a base weight in the range of approximately 20-500 g/m$^2$, for example 20-60 g/m$^2$.

The spun nonwoven material may consist of one or several of the following polymers: CoPA, CoPET, PET, low density polyethylene (LDPE) or PA. The base weight of the spun nonwoven material can be in the range of approximately 10 g/m$^2$-150 g/m$^2$. Since at least in the case of one press felt, the base structure is needled with one or more fibrous nonwoven layers during production, it is not necessary with regard to permeability of the completed clothing, that the films are permeable. Therefore the film(s) may be originally—that is during connection with the warp knit fabric—impermeable and are made permeable only through a needling process.

The connecting strip and/or the material strip is connected with the warp knit fabric, for example due to the effect of pressure and/or temperature. Here, it is feasible for the connecting strip or respectively strips and/or the material strip to melt at a lower temperature than the sewing threads and warp threads of the warp knit fabric. In this context, it is also conceivable that the two material segments are bonded, for example, by means of hot wire welding and/or ultrasound welding and/or laser welding. In hot wire welding it is, for example, conceivable that the two material segments which are to be connected with each other are placed on each other and are bonded with each other by fusing them together through use of a heated wire along a welding edge. After the welded edge is formed the two material segments which were placed on each other and which are bonded along the welded edge are arranged adjacent beside each other. It is also conceivable that the transverse and/or longitudinal edges are connected with each other by means of the hot wire melting process described above, with or without material strips. The welded edge can for example be smoothed out through ultrasound.

According to another embodiment of the present invention, the longitudinal module also includes a support layer in addition to the already described laid structure of longitudinal threads, arranged at the laid structure of longitudinal threads and connected with same. In this case the support layer extends, for example like the laid structure of longitudinal threads, along the entire width and length of the paper machine clothing. The support layer can be formed alone or in combination of one fibrous nonwoven layer, one film layer.

The laid structure of longitudinal threads, can be embedded into the fibrous nonwoven layer. This may be achieved, for example, by needling the laid structure of longitudinal threads with the support layer which is in the form of a fibrous nonwoven layer. It is possible that, due to the needling process, the support layer is destroyed to a great extent. In this case, the support layer can assume the task of holding the longitudinal threads of the laid thread structure in position during the additional production process of the felt belt.

An additional embodiment, of the present invention provides that the transverse reinforcement module is arranged on the support layer of the longitudinal reinforcement module and that it is bonded with same. In this instance, the support layer can, for example, be designed so that it can be easily connected with the transverse reinforcement module. In this context it is, for example, conceivable that the fibrous nonwoven layer in the form of a support layer includes melt adhesive fibers so that the transverse reinforcement module can be conglutinated with the support layer of the longitudinal reinforcement module through heat effect. The connection between the transverse reinforcement module and the longitudinal reinforcement module can be further improved through the effect of pressure, simultaneously applied with the heat effect. In order to achieve this, the longitudinal reinforcement module and the transverse reinforcement module may be guided together around a heated roll or through a heated press nip for the purpose of obtaining the heat effect.

Other integration techniques are of course also possible. It is, for example, conceivable that the transverse reinforcement module is connected with the longitudinal reinforcement module in that they are needled and/or sewn and/or welded together. It is conceivable in this context that, for example, the transverse reinforcement module is made endless, and is subsequently connected through needling in the needling machine with a longitudinal reinforcement module which was made or produced endless, as well as with one or more fibrous nonwoven layers. In this case, the integration can occur through needling alone or in combination with another bonding method.

The longitudinal reinforcement module made endless can already be produced in endless form or can have a seam which can be opened and closed, for example a seam with a pintle. For further simplification of the production of the clothing according to the present invention it is conceivable for the production of the support layer to use a pre-ready-made support web with a narrower width than the width of the clothing. In this case, the support web may consist of at least one support web extending in a substantially longitudinal direction of the clothing and which is continuously spirally wound in the cross direction of the clothing. The support layer in this case is produced in that a support web extending only on part of the width of the paper machine clothing is continuously spirally wound in the direction of the width of the paper machine clothing until the width of the clothing is reached. During the spiral winding process the edges of the support web facing each other can for example be arranged to abut each other or to overlap in areas.

According to a further embodiment of the present invention, the clothing can include a base structure which, for example, includes:

a) a longitudinal reinforcement module extending the width and length of the clothing, i) a laid structure of longitudinal threads extending the width and the length of the clothing which is formed by at least one longitudinal thread extending substantially in the longitudinal direction of the clothing and a support layer which is connected with the laid structure of longitudinal threads and extends across the width and along the length of the clothing; and/or ii) a woven or spiralized or knitted textile fabric; as well as b) a transverse reinforcement module having the same length and width as the clothing, which is arranged on the longitudinal reinforcement module and is connected with same, which includes a plurality of material segments formed from a warp knit fabric or consists of same, which respectively extend the width of the clothing and only on a part of the length of the clothing and which are arranged behind one another in the longitudinal direction of the clothing, together making up the length of the clothing. The warp knit fabric includes at least one system of warp threads arranged parallel to each other in their longitudinal orientation and sewing threads that form stitches whereby the stitch-forming sewing threads form at least one system of first sewing threads which extend diagonally or transversely to the warp threads and which integrate said warp threads with each other to form a textile fabric, wherein the warp threads in their longitudinal direction extend diagonally or transversely to the longitudinal direction of the clothing and have a greater flexural strength than the sewing threads.

For the provision of a press felt, on the side of the base structure of the clothing facing the paper side and/or the machine side at least one, for example several, fibrous nonwoven layer(s) may be arranged.

The paper machine clothing according to the present invention may be a press felt which is seamable in the machine, in particular a paper, cardboard or tissue machine. A press felt of this type has seam loops on its two open ends which, as a rule, are formed by monofilaments which can engage with each other for the purpose of making the press felt endless such that a tunnel is formed in the area of engagement through which a pintle can be inserted. Here, the seam loops are provided, for example, by the longitudinal reinforcement module.

The present invention further provides a method to produce the clothing, especially a press felt for a paper machine which has a length and a width, the method including the following steps:

a) provision of a longitudinal reinforcement module with a width and a length which is consistent with the width and length of the clothing which is to be produced, b) provision of a transverse reinforcement module with a width and a length which is consistent with the width and length of the clothing which is to be produced, c) locating the longitudinal reinforcement module and the transverse reinforcement module on top of each other; and d) connecting the transverse reinforcement module with the longitudinal reinforcement module.

The method of the present invention further provides that step b) may include at least the following steps:

i) provision of a material segment formed by at least one warp knit fabric, whereby the warp knit fabric includes at least one system of warp threads arranged parallel to each other in their longitudinal direction and sewing threads that form stitches whereby the stitch-forming sewing threads form at least one system of first sewing threads which extend diagonally or transversely to the warp threads and which integrate the warp threads with each other to form a textile fabric. The warp threads in their longitudinal direction have a greater flexural strength than the first sewing threads and the warp knit fabric has a length which is consistent with at least the width of the clothing which is to be produced; and further ii) where appropriate, trimming of the warp threads, so that the length of the material segment formed from the warp knit fabric is consistent with the width of the clothing which is to be produced.

The method according to the present invention further provides that step c) includes at least the step of:

iii) arranging the material segment formed from the warp knit fabric on the longitudinal reinforcement module so that the warp threads of the warp knit fabric extend diagonally or transversely to the longitudinal direction of the clothing. The sequence of steps i)-iii) is not stipulated. It is conceivable that first step i), then step iii) and subsequently step ii) are implemented. It is however also conceivable that first step i), then step ii) and lastly, step iii) are implemented.

To produce the transverse reinforcement module extending on the length and the width of the clothing, several material segments formed of the warp knit fabric and, respectively, having a width which is smaller than the length of the clothing which is to be produced, are provided and steps i)-iii) are repeated in such a way that the individual material segments respectively extend the width of the clothing and only on a part of the length of the clothing and are arranged behind one another in the longitudinal direction of the clothing, together making up the length of the clothing.

After trimming, the warp knit fabric can be backed on each trimmed edge with the previously described material strip in order to prevent fraying of the respective transverse edge. Before the subsequent needling process in which one or more fibrous nonwoven layers are needled onto the side of the base structure facing the paper and/or machine side, the transverse reinforcement module can be made endless. This can be done by abutting the two transverse edges of the transverse reinforcement module against each other and connecting them with the already described connecting strips.

Prior to arranging the longitudinal reinforcement module and transverse reinforcement module on top of each other as provided in step c), the longitudinal reinforcement module and/or the transverse reinforcement module can already be in the form of separately produced endless belts. It is therefore, for example, conceivable that the longitudinal reinforcement module is in the embodiment of an endless laid structure of longitudinal threads and the transverse reinforcement module is also in an endless form before they are arranged on each other and are connected with each other, for example through needling. It is however also conceivable that the longitudinal reinforcement module is in the embodiment of an endless woven or seamable woven fabric and the transverse reinforcement module is also endless before they are arranged on each other and are connected with each other, for example through needling. During the needling process one or several fibrous nonwoven layers are also needle bonded together with the longitudinal and the transverse reinforcement module, for example at the same time. The endless longitudinal reinforcement module can be produced to be endless or can have a seam which can be opened and closed.

According to a second embodiment of the method of the present invention to produce paper machine clothing, for example a press felt, the method includes the following steps:

a) provision of a web-type longitudinal reinforcement module having a length and a width;

b) provision of a material web formed by a warp knit fabric having a length and a width;

c) lateral feeding of the material web to the longitudinal reinforcement module;

d) placing the fed material web flat on the longitudinal reinforcement module;

e) separating the segment of the material web which has been placed on the longitudinal reinforcement module from the remaining material web, thus forming a material web segment;

f) moving the longitudinal reinforcement module in its longitudinal direction relative to the material web along a distance which is substantially consistent with the width of the warp knit fabric; and g) repeating steps c) to f) so that the individual material segments are arranged one after the other in the longitudinal direction of the felt belt.

With the method according to the present invention, it is easily possible to produce the transverse reinforcement module from a material web which is supplied in roll form. Further, the warp knit fabric of the present invention which includes at least one system of warp threads arranged parallel to each other in their longitudinal orientation and sewing threads that form stitches, the stitch-forming sewing threads including at least one system of first sewing threads which extend diagonally or transversely to the warp threads and which integrate the warp threads with each other to form a textile fabric. The warp threads in their longitudinal orientation extend diagonally or transversely to the longitudinal direction of the clothing and have a greater flexural strength than the sewing threads. A warp knit fabric of this type can be purchased in roll form as a mass produced product.

The method of the present invention may be implemented so that in the completed base structure each material segment which has been placed on the longitudinal reinforcement module extends the width of the longitudinal reinforcement module and that the material segments which are arranged behind one another in longitudinal direction of the clothing, together make up the length of the clothing.

In both embodiments of the method of the present invention, the material segments which were placed on the longitudinal reinforcement module are connected with the longitudinal reinforcement module.

Connecting the individual material segments which are formed from the warp knit fabric may, for example, include that the longitudinal reinforcement module and the material segments which are placed on it are subjected together to a heat treatment. Here, it is conceivable that the longitudinal reinforcement module and the material segments which are placed on it are guided together around a heated roll to receive the effects of heat.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION OF THE INVENTION

Figure 1:
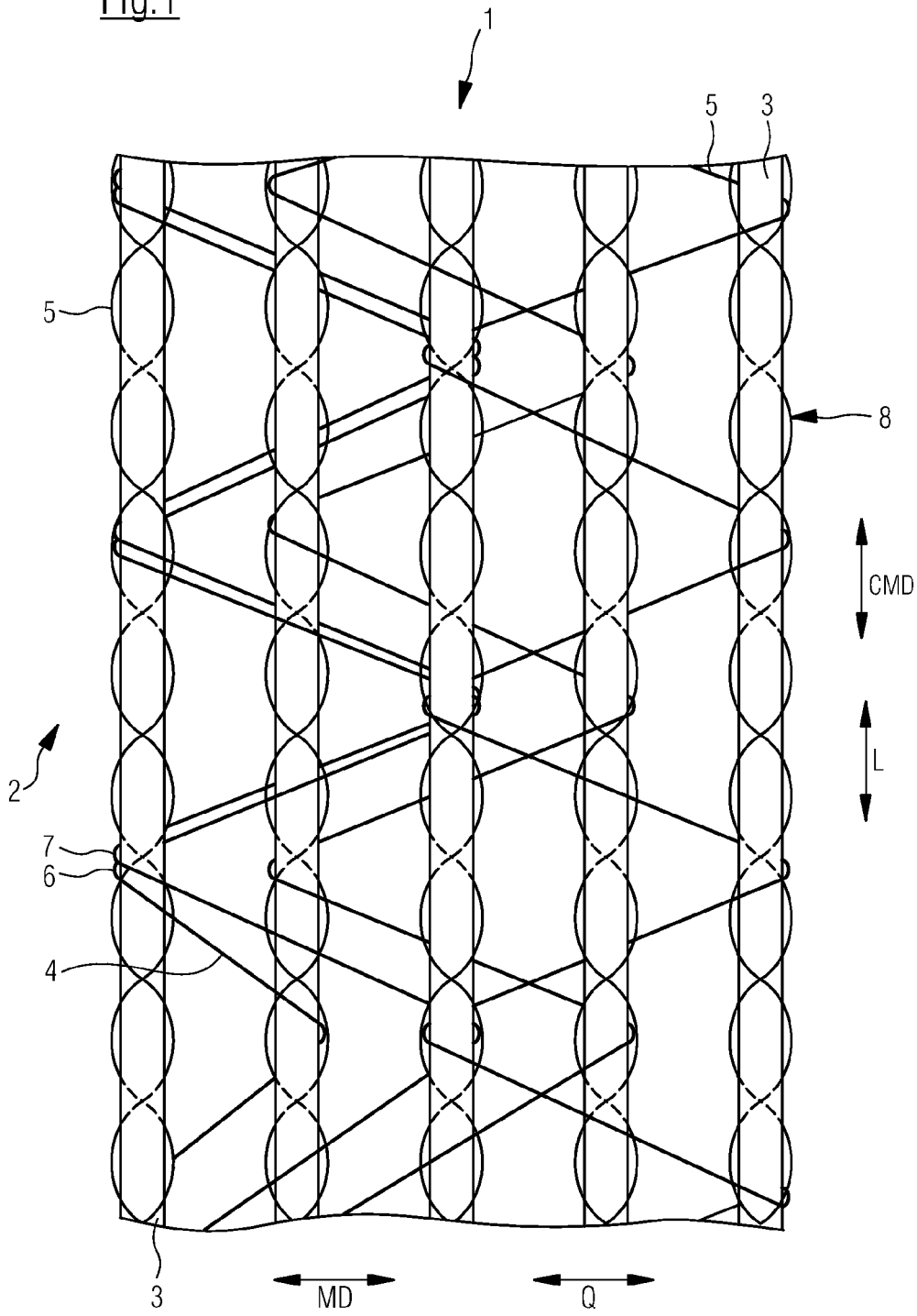
FIG. 1 is a top view of an embodiment of a transverse reinforcement module for a base structure of a press felt according to the present invention.

Referring now to the drawings, and more particularly to FIG. 1, there is shown a top view of one section of an embodiment of transverse reinforcement module 1 for a base structure of a press felt. Transverse reinforcement module 1 includes at least one material segment of a flat warp knit fabric. FIG. 1 is a sectional view of warp knit fabric 2. The warp knit fabric includes a one system of warp threads 3 arranged parallel to each other in their longitudinal orientation and sewing threads 4, 5 which form stitches 6, 7. Stitch-forming sewing threads 4, 5 form a system of first sewing threads 4 which extend diagonally or transversely to warp threads 3, as well as a system of second sewing threads 5.

Here, the system of first sewing threads 4 connects warp threads 3 with each other to form a textile fabric. Second sewing threads 5 moreover extend in the longitudinal direction of warp threads 3 and envelope warp threads 3, whereby first sewing threads 4 are integrated into stitches 7 of second sewing threads 5. In the current example, first and second sewing threads 4, 5 form common stitches.

As can be seen in FIG. 1, every second sewing thread 5 respectively envelops a warp thread 3, whereby every first sewing thread 4 is integrated into stitches 6 of several second sewing threads 5. Every warp thread 3 is integrated into one stitch row 8 of second sewing thread 5.

Second sewing threads 5 form rows 8 of stitches 7 which are arranged parallel to each other and extend along warp threads 3, whereby warp threads 3 are integrated into stitches 7 of second sewing threads 5. It can be seen that every second sewing thread 5 forms its own row 8 of stitches whereby each row 8 of stitches is formed by a fringe weave which is alternately offset along respective warp thread 3.

The warp knit fabric illustrated in FIG. 1 has the following structure:

LS 1: 1-0/0-1// fringe weave closed (second sewing thread (5))

LS 2: 0-0/0-0/1-1/1-1// (warp thread (3))

LS 3: 1-0/3-4// satin closed (first sewing thread (4))

However, the following structure would for example also be conceivable:

LS 1: 1-0/0-1// fringe weave open (second sewing thread)

LS 2: 0-0/0-0/1-1/1-1// (warp thread (3))

LS 3: 1-0/4-5// satin closed (first sewing thread)

Warp threads 3 extend in their length in cross direction CMD of the clothing and have a greater flexural strength than first and second sewing threads 4, 5.

Longitudinal direction L of warp knit fabric 2 is determined by the longitudinal extension of warp threads 3. First sewing threads 4 extend, for example, in zigzag lines between warp threads 3, whereby the zigzag lines progress in longitudinal direction L of warp knit fabric 2. Warp knit fabric 2 is arranged so that it extends in longitudinal direction L in cross direction CMD of the clothing.

Warp threads 3 can be formed by multifilament yarns, for example by twisted monofilaments.

Figure 2:
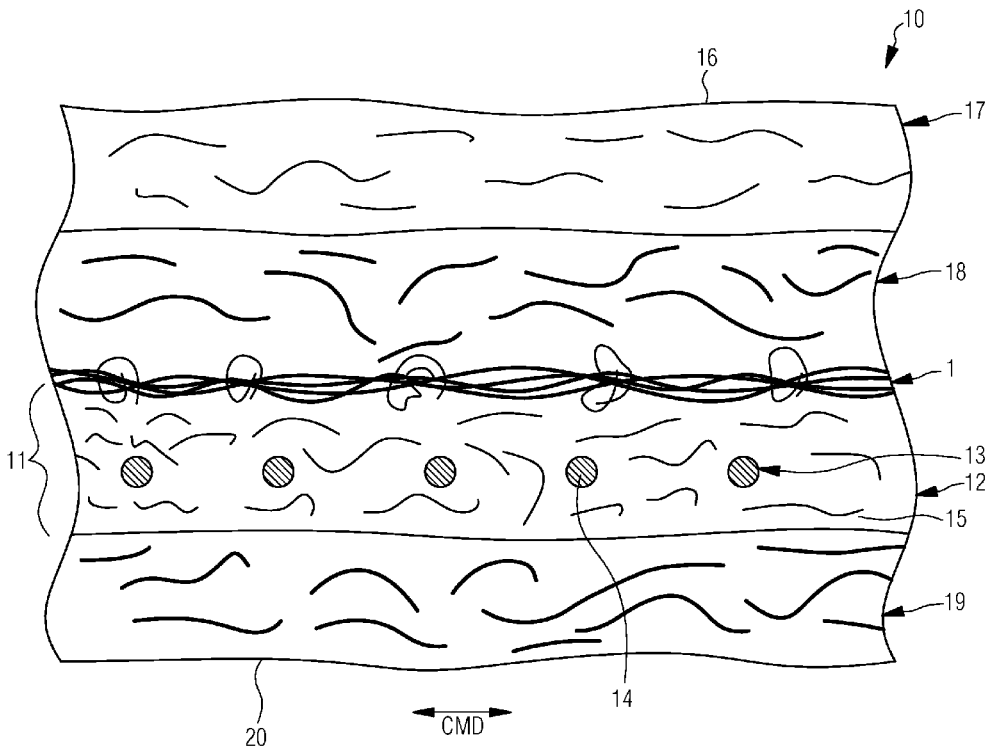
FIG. 2 is a cross section of an embodiment of a press felt according to the present invention with the transverse reinforcement module shown in FIG. 1.

Referring now to FIG. 2, there is shown a cross section of an embodiment of paper machine clothing 10 in the form of a press felt with transverse reinforcement module 1 shown in FIG. 1. Clothing 10 includes a load bearing base structure 11 which extends in the longitudinal direction and in cross direction CMD of clothing 10. In the current example, base structure 11 is formed by longitudinal reinforcement module 12 substantially providing the dimensional stability in longitudinal direction MD of clothing 10, as well as by transverse reinforcement module 1, substantially providing the dimensional stability in cross direction CMD of clothing 10 which is illustrated in FIG. 1, whereby transverse reinforcement module 1 is arranged on the longitudinal reinforcement module and is interconnected with same.

Longitudinal reinforcement module 12 illustrated in FIG. 2 includes a laid structure of longitudinal threads 13 consisting of several longitudinal threads 14 which extend substantially in the longitudinal direction of clothing 10 and are continuously spirally wound in cross direction CMD of clothing 10. Longitudinal reinforcement module 12 moreover includes support layer 15 in the embodiment of a fibrous nonwoven layer which is embedded into laid structure of longitudinal threads 13.

Fibrous nonwoven layer 15 can include melt adhesive fibers. In the current example, transverse reinforcement module 1 is connected with longitudinal reinforcement module 11 through conglutination with the melt adhesive fibers, in other words, transverse reinforcement module 1 is located on support layer 15 and is connected with same.

In clothing 10 in the embodiment of a press felt, two additional fibrous nonwoven layers 17, 18 are arranged on base structure 11 facing paper side 16 and are connected with base structure 11 through needling. Top fibrous nonwoven layer 17 representing the paper side 16 includes finer fibers than middle fibrous nonwoven layer 18 which is located between top fibrous nonwoven layer 17 and base structure 11.

In addition, clothing 10 in the embodiment of a press felt includes fibrous nonwoven layer 19 on the side of base structure 11 which faces machine side 20 and which is connected with base structure 11 through needling and which represents machine side 20 of clothing 10.

Figure 3:
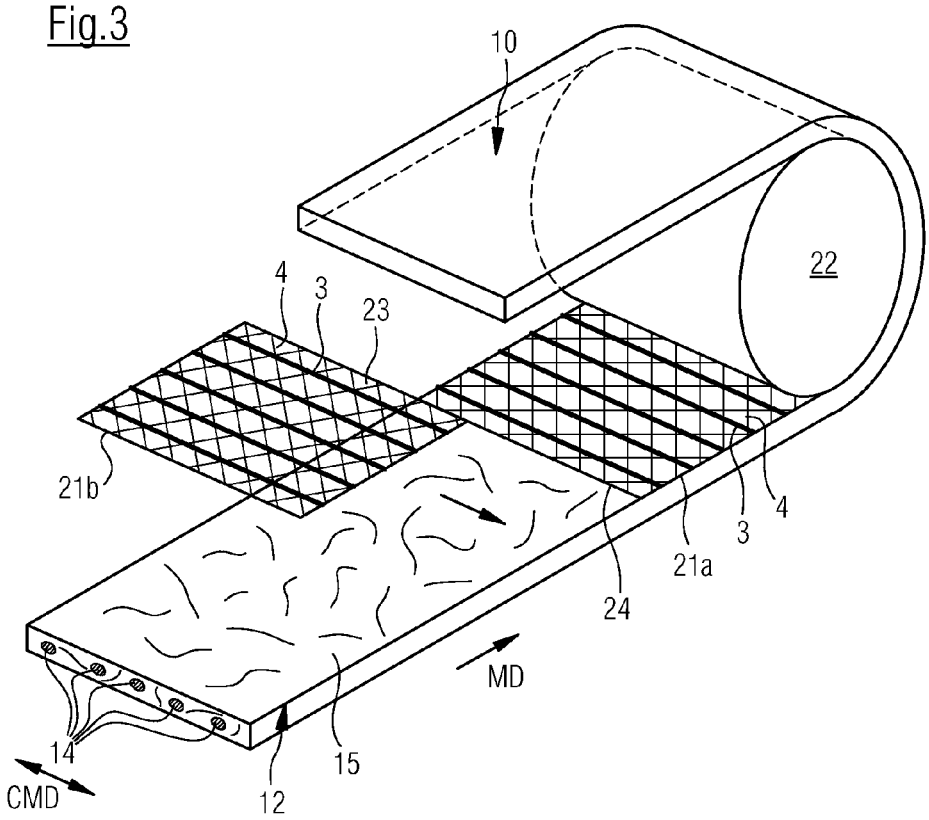
FIG. 3 is an embodiment of a method to produce an paper machine clothing according to the present invention.

Referring now to FIG. 3, there is shown an embodiment of a method of making a paper machine clothing according to the present invention. The already produced longitudinal reinforcement module 12 is shown which includes fibrous nonwoven layer 15 and longitudinal threads 14 embedded therein. Material segment 21*a* is illustrated which formed by the warp knit fabric shown in FIG. 1, which is already placed on longitudinal reinforcement module 12, and additional material segment 21*b*, also formed by of the warp knit fabric which is about to be placed on longitudinal reinforcement module 12. Prior to being placed on longitudinal reinforcement module 12, two material segments 21*a*, 21*b* were trimmed to the correct length, that is to the width of longitudinal reinforcement module 12, or respectively clothing 10. Material segments 21*a*, 21*b*, together with additional material segments which are not illustrated, form transverse reinforcement module 1 on longitudinal reinforcement module 12. All material segments are arranged on longitudinal reinforcement module 12 in such a way that the warp knit fabric extends in longitudinal direction L—that is in direction of the warp threads—in the cross direction of clothing 10 which is to be produced, and in transverse direction Q of the warp knit fabric extending in the longitudinal direction of clothing 10 which is to be produced. The material segments respectively extend the width of the clothing, but only on a part of the length of the clothing which is to be produced.

Material segments 21*a*, 21*b*, etc. are arranged on longitudinal reinforcement module 12 in such a way that they extend respectively on the width of clothing 10 and only on a part of the length of clothing 10, in a range of approximately 0.5 m to 8 m, and are arranged behind one another in longitudinal direction MD of clothing 10.

In the current example, all material segments 21*a*, 21*b*, etc. which are placed on longitudinal reinforcement module 12 are of the same type and could, for example, have been cut one after the other from a material web.

Figure 5:
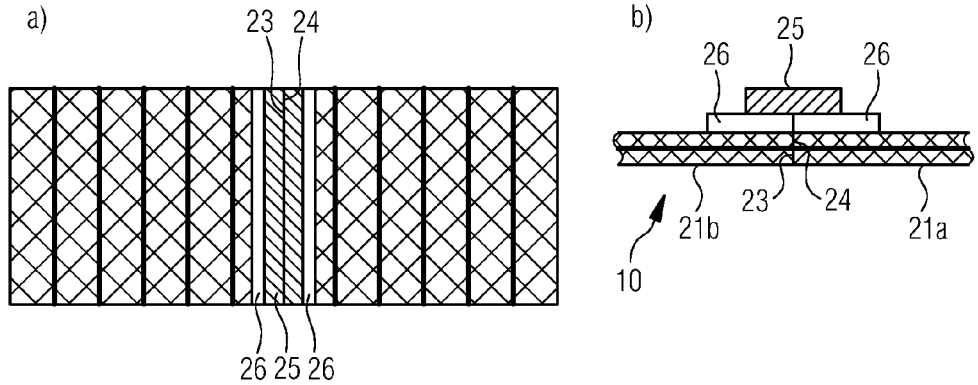
FIG. 5 is an embodiment of a method of connecting two adjacent material segments according to the present invention.

In the current example, transverse edges 23, 24 which are oriented in cross direction CMD of clothing 10 of adjacent material segments 21*a*, 21*b*, etc., including the warp knit fabric are abutted with each other. Moreover it is conceivable that, as illustrated, for example, in FIG. 5, that adjacent material segments 21*a*, 21*b* are connected by means of connecting strip 25, in that connecting strip 25 covers two abutting transverse edges 23, 24 and is interconnected with respective material segment 21*a*, 21*b* in the area of two transverse edges 23, 24.

In order to prevent fraying at transverse edges 23, 24, material strip 26 is connected with the respective material segment 21*a*, 21*b* whose edge is flush with respective transverse edge 23, 24.

After placement of a material segment 21*a*, 21*b*, etc. on longitudinal reinforcement module 12, material segments 21*a*, 21*b* are connected with longitudinal reinforcement model 12. In the current example, the connection between material segments 21*a*, 21*b*, etc. and longitudinal reinforcement module 12 occurs in that longitudinal reinforcement module 12 and material segments 21*a*, 21*b*, etc. placed on it are subjected to heat treatment in that they are guided around heated roll 22 together, whereby fibrous nonwoven layer 15 is bonded with material segments 21*a*, 21*b*, etc. due to the melt adhesive fibers arranged in it.

Warp threads 3 of material segments 21*a*, 21*b* which are formed by the warp knit fabric are arranged at a right angle to longitudinal direction MD of clothing 10.

The thus formed base structure 11 can subsequently also be provided on one side or on both sides with a fibrous nonwoven layer to complete clothing 10 in the embodiment of a press felt.

Figure 4:
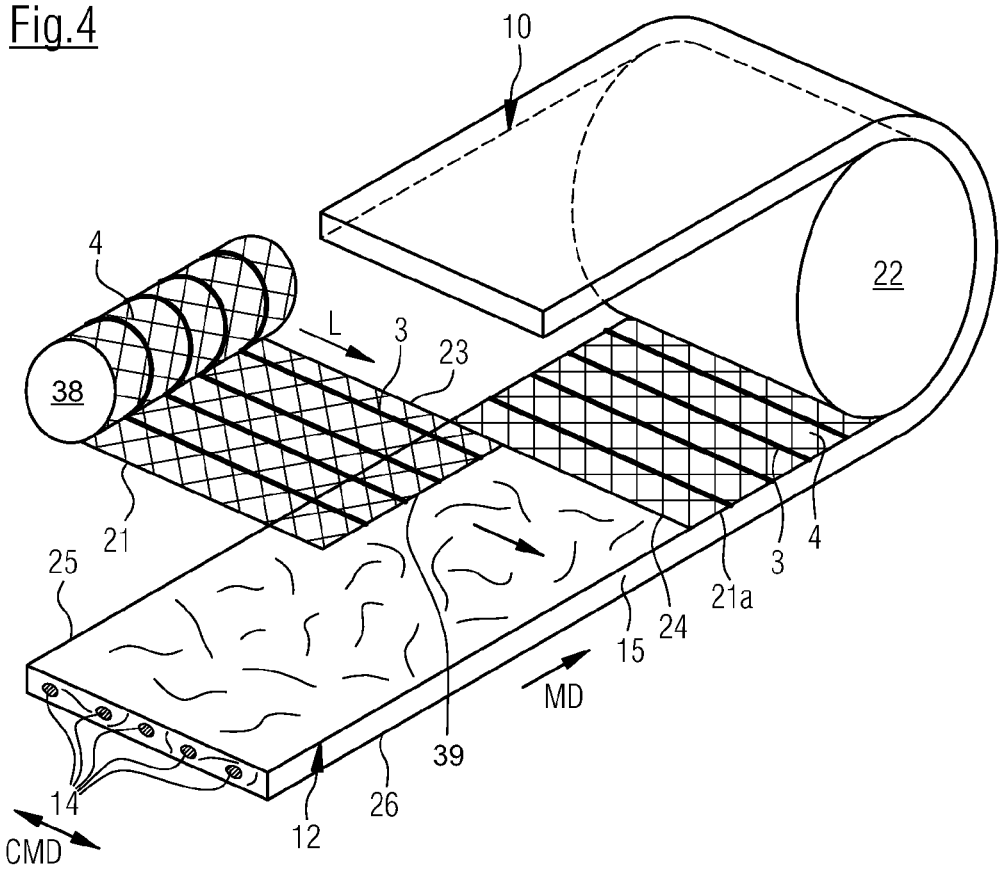
FIG. 4 is an embodiment of a method to produce an paper machine clothing according to the present invention.

Referring now to FIG. 4, there is shown an embodiment of a method to produce a paper machine clothing according to the present invention, in particular a press felt, including the following steps: Web-type longitudinal reinforcement module 12 having a length and a width is provided. Moreover, material web 21 having a length and a width produced from the warp knit fabric illustrated in FIG. 1 is provided which is wound on roll 38 and is available as a rolled product. Material web 21, in longitudinal direction L of the material web is fed laterally into longitudinal reinforcement module 12, in other words in cross machine direction CMD of the clothing, whereby respective free end 39 of the source web of transverse reinforcement module 12 is guided from longitudinal edge 25 of longitudinal reinforcement module 12 to other longitudinal edge 26 of longitudinal reinforcement module 12 (see arrow). The web is placed on longitudinal reinforcement module 12 during or after the feeding process. After the placement, material segment 21 having been placed on longitudinal reinforcement module 12 is severed from remaining material web 21, thereby forming additional material segment 21*b*.

Alternatively, material segment 21*a* which is to be placed on longitudinal reinforcement module 12 can already be severed from remaining material web 21 during placement of material web 21 on longitudinal reinforcement module 12. As can be seen from the illustration in FIG. 4, material segments 21*a*, 21*b* are cut in such a way that their length is consistent with the width of longitudinal reinforcement module 21, or respectively clothing 10.

In the illustration in FIG. 4, material segment 21*a* was already placed on longitudinal reinforcement module 12 according to the steps just described, while in the illustration material web 21 is fed laterally to longitudinal reinforcement module 12 and is placed on it, and after having been placed (not illustrated) is cut so that additional material segment 21*b* extends on the length of longitudinal reinforcement module 12.

After placement of material segment 21*a* in the embodiment of the warp knit fabric on longitudinal reinforcement module 12, longitudinal reinforcement module 12 is moved in its longitudinal direction MD relative to material web 21 along a distance which is essentially consistent with the width of material web 21. Repeating the previously described steps results in that the individual material segments 21*a*, 21*b*, etc. are arranged one after the other in longitudinal direction MD of press felt 10.

In the current example, the method according to the present invention is implemented in such a way that, in the completed base structure each of material segments 21*a*, 21*b* which are placed on longitudinal reinforcement module 12 extends the width of longitudinal reinforcement module 12 and that material segments 21*a*, 21*b* which are arranged after one another, together with additional material segments which are not illustrated, complete a continuous layer and form the transverse reinforcement module.

As described in the method illustrated in FIG. 4, the placed transverse reinforcement module segments 21*a*, 21*b* are connected with longitudinal reinforcement module 12 and transverse reinforcement module segments 21*a*, 21*b* placed on it are subjected together to a heat treatment in that they are guided around heated roll 22.

Figure 6:
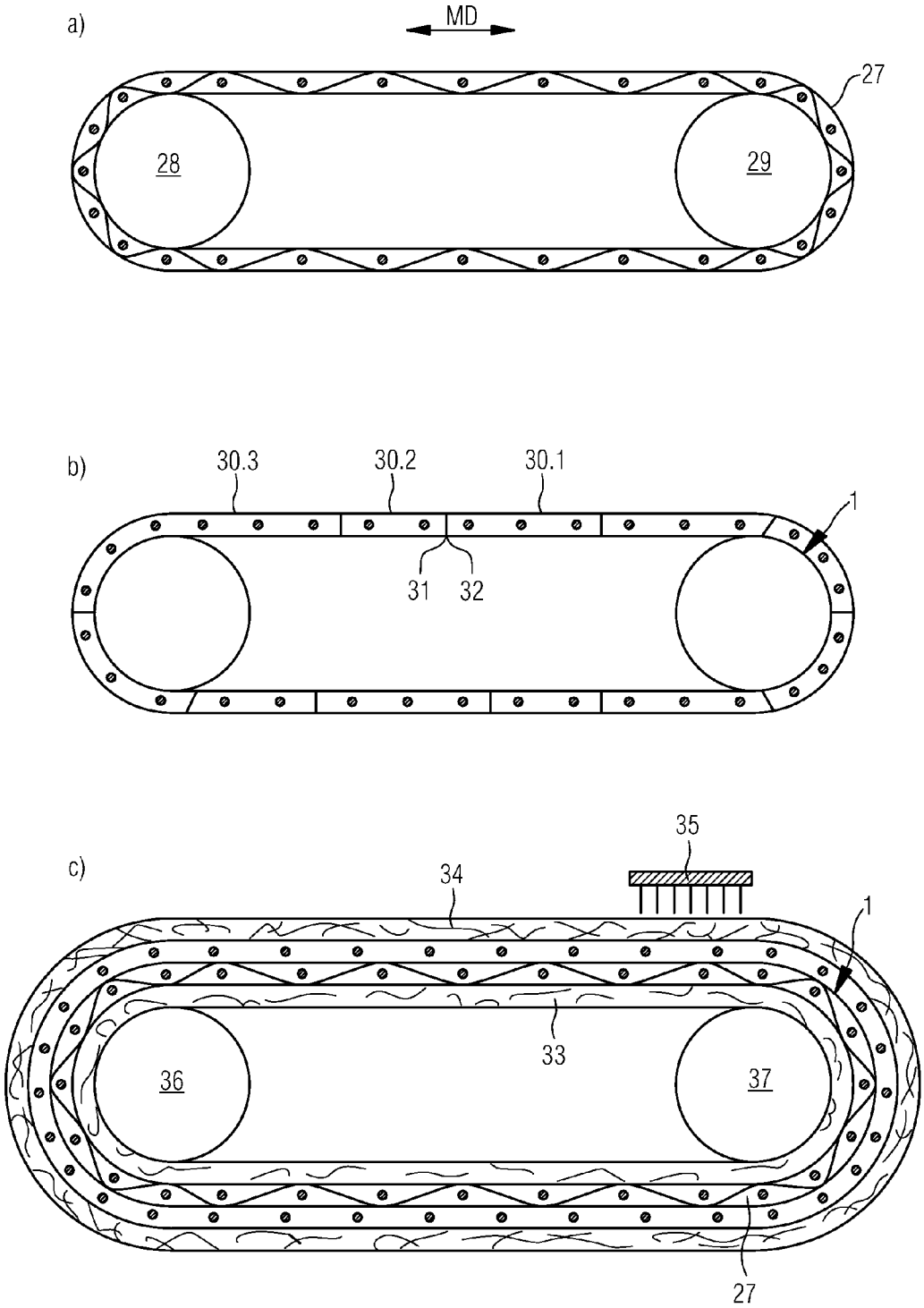
FIG. 6 is an embodiment of a method to produce a paper machine clothing according to the present invention.

An additional alternative possibility to produce a press felt according to the present invention is shown in FIGS. 6*a*-6*c*. Longitudinal reinforcement module 27 is provided in the form of an endless belt. This can be in the form of a laid structure of longitudinal threads, or as shown in FIG. 6*a*, in the form of a textile fabric in the embodiment of an endless woven fabric which is suitable to substantially provide the longitudinal stability of the clothing. Alternatively, it could also be a seamable woven fabric or a laid structure of threads. During the process of making woven fabric 27 endless it can be stretched between two rolls 28, 29 which are positioned parallel to each other.

An inventive transverse reinforcement module 1 is provided in an additional production step. Here, a plurality of material segments 30.1, 30.2, 30.3, etc., in the form of warp knit fabric which extend respectively the width of the clothing and only on a part of the provided length of the clothing are arranged in longitudinal direction of the clothing one after the other and together make up the length of the clothing and are connected together at respective transverse edges 31, 32 facing each other, for example, with connecting strips or with hot wire welding, thus forming transverse reinforcement module 1 in the embodiment of an endless belt.

In the production step illustrated in FIG. 6*c*, endless longitudinal reinforcement module 27, endless transverse reinforcement module 1, as well as fibrous layers 33, 34 which are arranged on top and underneath of them are combined with each other through needling. Endless longitudinal reinforcement module 27 and endless transverse reinforcement module 1 are placed on each other for this purpose in that they are pulled over two rolls 36, 37 which are located at a distance from each other and parallel to each other. Longitudinal reinforcement module 27 and transverse reinforcement module 1 placed on it, together with fibrous nonwoven layers 33, 34 are fed into needling device 35 where the entire arrangement of longitudinal reinforcement module 27, transverse reinforcement module 1 and fibrous nonwoven layers 33, 34 are needled together.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A paper machine clothing, formed as a press felt, for one of a paper, a cardboard and a tissue machine, said paper machine clothing comprising:

a load bearing base structure which extends in a longitudinal direction and a cross direction of the paper machine clothing, said load bearing base structure including a longitudinal reinforcement module substantially providing a dimensional stability in said longitudinal direction of the paper machine clothing and a transverse reinforcement module arranged on top of said longitudinal reinforcement module, connected to said longitudinal reinforcement module, and at least partially providing said dimensional stability in said cross direction of said paper machine clothing, said transverse reinforcement module including at least one material segment being a warp knit fabric including at least one system of warp threads arranged parallel to each other in a longitudinal direction of said warp threads and in said longitudinal direction of said warp threads extending transversely to said longitudinal direction of said clothing and a plurality sewing threads that form stitches, said stitch forming sewing threads including at least one system of first sewing threads extending one of diagonally and transversely to said warp threads and which integrate said warp threads with each other to form a textile fabric, said warp threads having a greater flexural strength than said sewing threads.

2. The paper machine clothing according to claim 1, wherein said transverse reinforcement module substantially provides said dimensional stability in said cross direction of the clothing.

3. The paper machine clothing according to claim 2, said longitudinal reinforcement module further comprising a laid structure of including plurality of longitudinal threads, at least one of said plurality of longitudinal threads extending substantially in said longitudinal direction of said paper machine clothing and wound continuously spirally in said cross direction of said paper machine clothing.

4. The paper machine clothing according to claim 3, said stitch-forming sewing threads further comprising at least one system of second sewing threads which form a plurality of stitch rows extending in said longitudinal direction of said warp threads and enveloping said warp threads at least in sections, said second sewing threads being tied into a plurality of stitches of said first sewing threads, said warp threads having a greater flexural strength than said second sewing threads.

5. The paper machine clothing according to claim 4, wherein each of said second sewing threads is integrated into a predetermined number of said stitches of said first sewing threads.

6. The paper machine clothing according to claim 4, wherein on integration of one of said second sewing threads into a respective stitch of said first sewing thread, said respective first sewing thread and said one of said second sewing threads form a common stitch.

7. The paper machine clothing according to claim 6, wherein each of said second sewing threads forms a respective row of stitches.

8. The paper machine clothing according to claim 4, wherein each of said rows of stitches is formed by a fringe weave alternately offset along a respective one of said warp threads.

9. The paper machine clothing according to claim 7, wherein each of said first sewing threads integrating said warp threads forms one of a cord and a velvet weave.

10. The paper machine clothing according to claim 1, wherein said warp threads are formed by multifilament yarns.

11. The paper machine clothing according to claim 10, wherein said warp threads are formed by twisted monofilaments.

12. The paper machine clothing according to claim 1, wherein said warp knit fabric is produced flat.

13. The paper machine clothing according to claim 1, said transverse reinforcement module further comprising at least one material segment being said warp knit fabric extending on a width of the paper machine clothing.

14. The paper machine clothing according to claim 13, wherein said at least one material segment is a plurality of material segments each extending respectively on said width of the paper machine clothing and only on a part of a length of the paper machine clothing, said plurality of material segments being arranged behind one another in said longitudinal direction of the paper machine clothing and together making up said length of the paper machine clothing.

15. The paper machine clothing according to claim 14, wherein each of said material segments extends on said width of the paper machine clothing in a range between approximately 0.5 and 8 meters in said longitudinal direction of the paper machine clothing.

16. The paper machine clothing according to claim 15, wherein a respective material segment of said at least one material segment has a length limited by two transverse edges extending transversely to said longitudinal direction of the paper machine clothing.

17. The paper machine clothing according to claim 16, wherein one of said transverse edges of each of adjacent said material segments abut each other to make said transverse reinforcement module endless.

18. The paper machine clothing according to claim 17, further comprising a connecting strip covering said two abutting transverse edges and interconnecting with a respective said material segment in an area of said abutting transverse edges.

19. The paper machine clothing according to claim 18, further comprising a material strip connected with a respective material segment having an edge flush with a respective said transverse edge.

20. The paper machine clothing according to claim 19, wherein at least one of said connecting strip and said material strip is made of at least one of one spun nonwoven material and at least one film.

21. The paper machine clothing according to claim 20, wherein at least one of said connecting strip and said material strip is connected with said warp knit fabric with the effects of at least one of pressure and temperature.

22. The paper machine clothing according to claim 21, said longitudinal reinforcement module further comprising a support layer arranged at said laid structure of said plurality of longitudinal threads and is connected with said laid structure of said longitudinal threads.

23. The paper machine clothing according to claim 22, wherein said support layer is formed by at least one of a fibrous nonwoven layer and a film layer.

24. The paper machine clothing according to claim 23, wherein said laid structure of said longitudinal threads is embedded into said fibrous nonwoven layer.

25. The paper machine clothing according to claim 24, wherein said fibrous nonwoven layer includes melt adhesive fibers.

26. The paper machine clothing according to claim 25, wherein said transverse reinforcement module and said longitudinal reinforcement module are at least one of congluti-nated, sewn and welded to connect said transverse reinforcement module and said longitudinal reinforcement module together.

27. The paper machine clothing according to claim 26, wherein said transverse reinforcement module is arranged on and bonded with said support layer of said longitudinal reinforcement module.

28. The paper machine clothing according to claim 27, wherein said support layer is in the form of said fibrous nonwoven layer and said laid structure of said longitudinal threads is needled together with said support layer.

29. The paper machine clothing according to claim 28, wherein said support layer is formed from at least one support web extending substantially in said longitudinal direction of the paper machine clothing and is continuously spirally wound in said cross direction of the paper machine clothing.

30. The paper machine clothing according to claim 29, wherein edges of said support web facing each other are one of abutted and overlapping in an area of said support web during said spiral winding.

31. The paper machine clothing according to claim 30, wherein at least one fibrous nonwoven layer is arranged on a side of said base structure of the paper machine clothing facing at least one of a machine side and a paper side of the paper machine clothing.

32. A method of producing a paper machine clothing having a length and a width, the method comprising the steps of:

providing a longitudinal reinforcement module having a second length and a second width consistent with said length and width of said paper machine clothing;

providing a transverse reinforcement module having a third length and a third width consistent with said length and width of said paper machine clothing;

locating said longitudinal reinforcement module and said transverse reinforcement module on top of each other, said locating step including the steps of:

providing a material segment of at least one warp knit fabric including at least one system of warp threads arranged parallel to each other in a longitudinal direction of said warp threads and providing a plurality of stitch-forming threads including at least one system of first sewing threads extending one of diagonally and transversely to said warp threads and integrating said warp threads with each other to form a textile fabric, said warp threads in said longitudinal direction of said warp threads having a greater flexural strength than said first sewing threads and said warp knit fabric having a fourth length consistent with at least said width of the clothing being produced; and arranging said material segment on said longitudinal reinforcement module so said warp threads of said warp knit fabric in said longitudinal direction of said warp knit threads extends in a cross direction of the paper machine clothing; and connecting said transverse reinforcement module with said longitudinal reinforcement module.

33. The method according to claim 32, the locating step further comprising the step of trimming said warp threads so that a length of said material segment is consistent with said width of the paper machine clothing.

34. The method according to claim 32, further comprising the step of producing the paper machine clothing as a press felt for use in a paper machine.

35. The method according to claim 33, the connecting step further comprising the step of arranging said material segment on said longitudinal reinforcement module so said warp threads of said warp knit fabric in said longitudinal direction of said warp threads extend in said cross direction of the paper machine clothing.

36. The method according to claim 35, further comprising the step of providing a plurality of said material segments of said warp knit fabric having a fourth width smaller than said length of the paper machine clothing and repeating said providing said material segment step, said trimming said warp threads step and said arranging said material segment step so that said plurality of material segments respectively extend on said width of the paper machine clothing and only on a part of said length of the paper machine clothing, said plurality of material segments being arranged behind one another in said longitudinal direction of the paper machine clothing and making up said length of the paper machine clothing.

* * * * *